US010317823B2

(12) United States Patent
Fujimoto et al.

(10) Patent No.: US 10,317,823 B2
(45) Date of Patent: Jun. 11, 2019

(54) FIXING DEVICE AND IMAGE FORMING APPARATUS HAVING A THERMAL CONDUCTION AID CONTACTING A NIP FORMATION PAD

(71) Applicant: Ricoh Company, Ltd., Tokyo (JP)

(72) Inventors: Ippei Fujimoto, Kanagawa (JP); Hiroshi Yoshinaga, Chiba (JP); Kenji Ishii, Kanagawa (JP); Hiroyuki Shimada, Tokyo (JP); Takashi Seto, Kanagawa (JP); Takayuki Seki, Kanagawa (JP); Kazunari Sawada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/924,631

(22) Filed: Mar. 19, 2018

(65) Prior Publication Data

US 2018/0284669 A1 Oct. 4, 2018

(30) Foreign Application Priority Data

Mar. 28, 2017 (JP) ..... 2017-063377

(51) Int. Cl.
*G03G 15/20* (2006.01)

(52) U.S. Cl.
CPC ..... *G03G 15/2028* (2013.01); *G03G 15/206* (2013.01); *G03G 15/2039* (2013.01);
(Continued)

(58) Field of Classification Search
CPC ..... G03G 15/2028; G03G 15/2039; G03G 15/206; G03G 15/2053; G03G 15/2064; G03G 2215/2016; G03G 2215/2035
See application file for complete search history.

(56) References Cited

U.S. PATENT DOCUMENTS

2009/0208264 A1* 8/2009 Fujiwara ..... G03G 15/2064 399/329
2010/0247130 A1* 9/2010 Ishida ..... G03G 15/5012 399/69

(Continued)

FOREIGN PATENT DOCUMENTS

JP 4-044083 2/1992
JP 2004-286922 10/2004

(Continued)

OTHER PUBLICATIONS

U.S. Appl. No. 15/684,298, filed Aug. 23, 2017 Kazunari Sawada, et al.

(Continued)

*Primary Examiner* — David M. Gray
*Assistant Examiner* — Laura Roth
(74) *Attorney, Agent, or Firm* — Oblon, McClelland, Maier & Neustadt, L.L.P.

(57) ABSTRACT

A fixing device includes a fixing rotator and a lateral end heater to heat a lateral end span of the fixing rotator in an axial direction thereof. A thermal conduction aid contacts the fixing rotator. A nip formation pad contacts the thermal conduction aid. A lateral end temperature detector detects a temperature of the fixing rotator in a lateral end detection span in the axial direction of the fixing rotator. The thermal conduction aid contacts the nip formation pad in a first span including the lateral end detection span in the axial direction of the fixing rotator with a first contact area. The thermal conduction aid contacts the nip formation pad in a second span disposed outboard from the first span in the axial direction of the fixing rotator with a second contact area smaller than the first contact area.

15 Claims, 11 Drawing Sheets

(52) U.S. Cl.
CPC ..... *G03G 15/2053* (2013.01); *G03G 15/2064* (2013.01); *G03G 2215/2016* (2013.01); *G03G 2215/2035* (2013.01)

(56) References Cited

U.S. PATENT DOCUMENTS

| | | | | |
|---|---|---|---|---|
| 2012/0121303 | A1 | 5/2012 | Takagi et al. | |
| 2013/0279955 | A1* | 10/2013 | Maeda | G03G 15/2053 399/329 |
| 2015/0030362 | A1 | 1/2015 | Bae et al. | |
| 2015/0055994 | A1* | 2/2015 | Shoji | G03G 15/2053 399/329 |
| 2015/0185671 | A1* | 7/2015 | Ikebuchi | G03G 15/2042 399/69 |
| 2015/0261155 | A1 | 9/2015 | Yoshiura et al. | |
| 2015/0261157 | A1* | 9/2015 | Yamano | G03G 15/2053 399/329 |
| 2016/0274514 | A1 | 9/2016 | Ishii et al. | |
| 2016/0334742 | A1 | 11/2016 | Kobashigawa et al. | |
| 2016/0378027 | A1 | 12/2016 | Sawada et al. | |
| 2017/0017182 | A1* | 1/2017 | Saito | G03G 15/2042 |
| 2017/0176906 | A1 | 6/2017 | Sawada et al. | |
| 2017/0176907 | A1 | 6/2017 | Sawada et al. | |
| 2017/0185009 | A1 | 6/2017 | Yoshinaga et al. | |
| 2017/0185020 | A1 | 6/2017 | Seki et al. | |
| 2017/0185021 | A1 | 6/2017 | Seki et al. | |
| 2017/0255147 | A1* | 9/2017 | Seki | G03G 15/2053 |
| 2017/0261900 | A1* | 9/2017 | Sawada | G03G 15/2053 |
| 2017/0364000 | A1* | 12/2017 | Seki | G03G 15/2053 |
| 2018/0017910 | A1* | 1/2018 | Sawada | G03G 15/2025 |
| 2018/0120741 | A1* | 5/2018 | Yoshinaga | G03G 15/2017 |

FOREIGN PATENT DOCUMENTS

| | | |
|---|---|---|
| JP | 2012-118488 | 6/2012 |
| JP | 2016-033636 | 3/2016 |
| JP | 2016-173559 | 9/2016 |

OTHER PUBLICATIONS

U.S. Appl. No. 15/783,199, filed Oct. 13, 2017 Hiroshi Yoshinaga, et al.

* cited by examiner

FIXING DEVICE AND IMAGE FORMING APPARATUS HAVING A THERMAL CONDUCTION AID CONTACTING A NIP FORMATION PAD

CROSS-REFERENCE TO RELATED APPLICATION

This patent application is based on and claims priority pursuant to 35 U.S.C. § 119 to Japanese Patent Application No. 2017-063377, filed on Mar. 28, 2017, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

The fixing device may further include a thermal conduction aid over which the fixing belt slides. Heat generated by the heater may diffuse to a lateral end of the thermal conduction aid in a longitudinal direction thereof, decreasing the temperature of a lateral end of the fixing belt that contacts the thermal conduction aid. Accordingly, the fixing belt may degrade fixing performance to fix the toner image on a lateral end of the sheet.

SUMMARY

This specification describes below an improved fixing device. In one embodiment, the fixing device includes a fixing rotator that is endless and rotatable in a rotation direction and a lateral end heater to heat a lateral end span of the fixing rotator in an axial direction of the fixing rotator. A thermal conduction aid contacts an inner circumferential surface of the fixing rotator. A nip formation pad contacts the thermal conduction aid. A pressure rotator presses against the nip formation pad via the fixing rotator and the thermal conduction aid to form a fixing nip between the fixing rotator and the pressure rotator, through which a recording medium bearing a toner image is conveyed. A lateral end temperature detector detects a temperature of the fixing rotator in a lateral end detection span in the axial direction of the fixing rotator. The thermal conduction aid contacts the nip formation pad in a first span including the lateral end detection span in the axial direction of the fixing rotator with a first contact area. The thermal conduction aid contacts the nip formation pad in a second span disposed outboard from the first span in the axial direction of the fixing rotator with a second contact area smaller than the first contact area.

This specification further describes an improved fixing device. In one embodiment, the fixing device includes a fixing rotator that is endless and rotatable in a rotation direction and a thermal conduction aid contacting an inner circumferential surface of the fixing rotator. A nip formation pad contacts the thermal conduction aid. A pressure rotator presses against the nip formation pad via the fixing rotator and the thermal conduction aid to form a fixing nip between the fixing rotator and the pressure rotator, through which a recording medium bearing a toner image is conveyed. A temperature detector detects a temperature of the fixing rotator in a detection span within a recording medium conveyance span in an axial direction of the fixing rotator, where the recording medium is conveyed. A heater heats the fixing rotator. A controller controls the heater to heat the fixing rotator to a target temperature based on the temperature of the fixing rotator detected by the temperature detector. The thermal conduction aid conducts heat to the nip formation pad in the detection span in the axial direction of the fixing rotator with a first amount. The thermal conduction aid conducts heat to the nip formation pad in an outboard span disposed outboard from the recording medium conveyance span in the axial direction of the fixing rotator with a second amount smaller than the first amount.

This specification further describes an improved image forming apparatus. In one embodiment, the image forming apparatus includes an image bearer to bear a toner image and a fixing device to fix the toner image on a recording medium. The fixing device includes a fixing rotator that is endless and rotatable in a rotation direction and a lateral end heater to heat a lateral end span of the fixing rotator in an axial direction of the fixing rotator. A thermal conduction aid contacts an inner circumferential surface of the fixing rotator. A nip formation pad contacts the thermal conduction aid. A pressure rotator presses against the nip formation pad via the fixing rotator and the thermal conduction aid to form a fixing nip between the fixing rotator and the pressure rotator, through which the recording medium bearing the toner image is conveyed. A lateral end temperature detector detects a temperature of the fixing rotator in a lateral end detection span in the axial direction of the fixing rotator. The thermal conduction aid contacts the nip formation pad in a first span including the lateral end detection span in the axial direction of the fixing rotator with a first contact area. The thermal conduction aid contacts the nip formation pad in a second span disposed outboard from the first span in the axial direction of the fixing rotator with a second contact area smaller than the first contact area.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
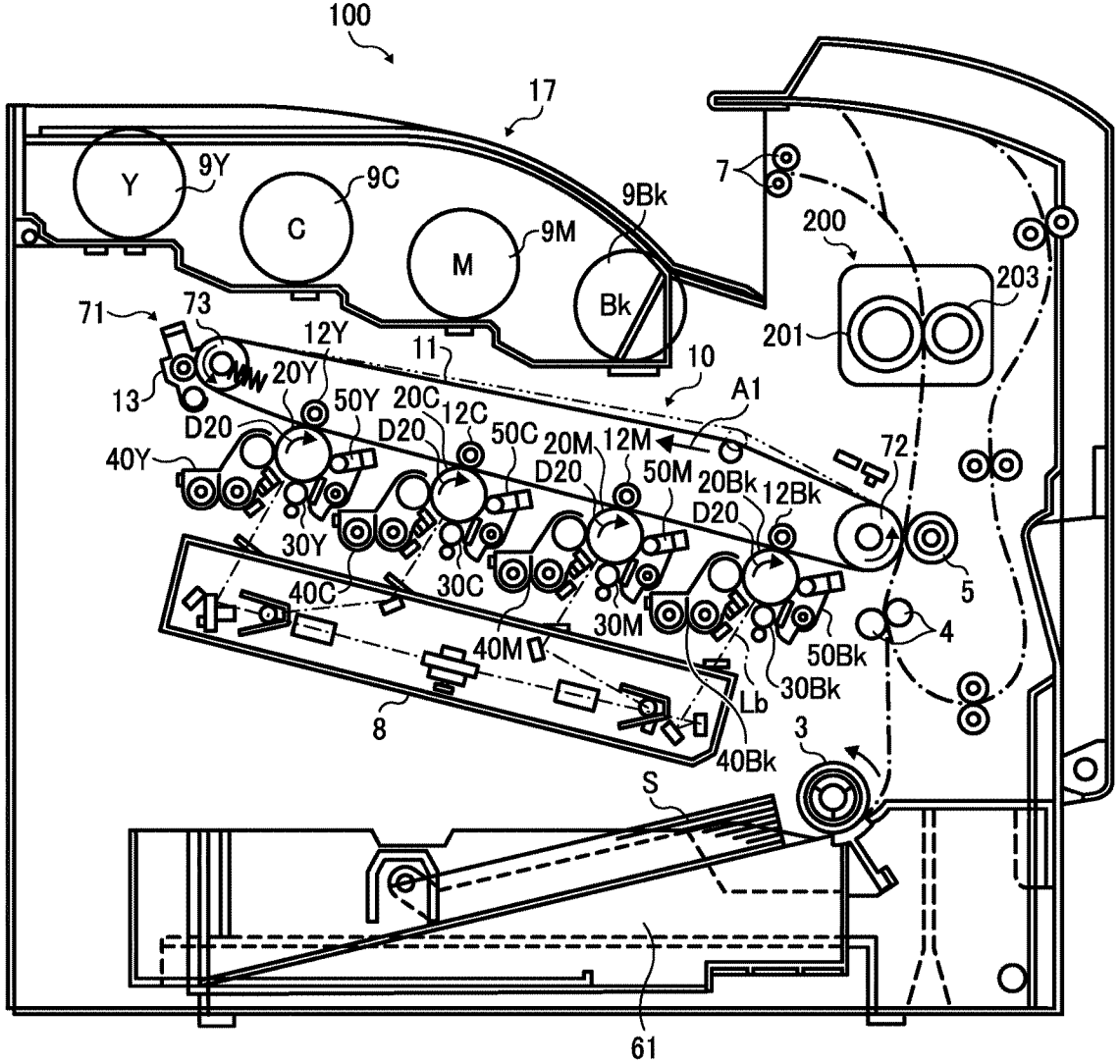
FIG. 1 is a schematic vertical cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 100 according to an embodiment is explained.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least two of copying, printing, scanning, facsimile, and plotter functions, or the like. According to this embodiment, the image forming apparatus 100 is a color printer that forms a color toner image on a recording medium by electrophotography. Alternatively, the image forming apparatus 100 may be a monochrome printer that forms a monochrome toner image on a recording medium.

Referring to FIG. 1, a description is provided of a construction of the image forming apparatus 100.

As illustrated in FIG. 1, the image forming apparatus 100 is a color printer employing a tandem system in which a plurality of image forming devices for forming toner images in a plurality of colors, respectively, is aligned in a rotation direction of a transfer belt.

The image forming apparatus 100 employs a tandem structure in which photoconductive drums 20Y, 20C, 20M, and 20Bk serving as image bearers that bear yellow, cyan, magenta, and black toner images in separation colors, respectively, are aligned.

Although FIG. 1 illustrates the color printer employing the tandem system as one example of the image forming apparatus 100, the image forming apparatus 100 may employ other systems. The image forming apparatus 100 may be a copier, a facsimile machine, a printer, a multifunction peripheral or a multifunction printer (MFP) having at least two of copying, printing, scanning, facsimile, and plotter functions, or the like.

The yellow, cyan, magenta, and black toner images formed on the photoconductive drums 20Y, 20C, 20M, and 20Bk, respectively, as visible images are primarily transferred successively onto a transfer belt 11, that is, an endless belt serving as an intermediate transferor, disposed opposite the photoconductive drums 20Y, 20C, 20M, and 20Bk as the transfer belt 11 rotates in a rotation direction A1 in a primary transfer process. Through the primary transfer process, the yellow, cyan, magenta, and black toner images are superimposed on the transfer belt 11 and then secondarily transferred onto a recording sheet S serving as a recording medium collectively in a secondary transfer process.

Each of the photoconductive drums 20Y, 20C, 20M, and 20Bk is surrounded by image forming components that form a toner image on each of the photoconductive drums 20Y, 20C, 20M, and 20Bk as each of the photoconductive drums 20Y, 20C, 20M, and 20Bk rotates clockwise in FIG. 1 in a rotation direction D20, thus constructing an image forming unit serving as the image forming device. Taking the image forming unit incorporating the photoconductive drum 20Bk, the following describes an image forming operation to form the black toner image. The image forming unit includes a charger 30Bk, a developing device 40Bk, a primary transfer roller 12Bk, and a cleaner 50Bk that surround the photoconductive drum 20Bk in this order in the rotation direction D20 of the photoconductive drum 20Bk. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. After the charger 30Bk charges the photoconductive drum 20Bk, an optical writing device 8 writes an electrostatic latent image on the photoconductive drum 20Bk with a laser beam Lb.

As the transfer belt 11 rotates in the rotation direction A1, the yellow, cyan, magenta, and black toner images formed on the photoconductive drums 20Y, 20C, 20M, and 20Bk, respectively, as visible images are primarily transferred successively onto the transfer belt 11, thus being superimposed on a same position on the transfer belt 11. In the primary transfer process, the primary transfer rollers 12Y, 12C, 12M, and 12Bk disposed opposite the photoconductive drums 20Y, 20C, 20M, and 20Bk via the transfer belt 11, respectively, apply a primary transfer bias to the photoconductive drums 20Y, 20C, 20M, and 20Bk successively from the upstream photoconductive drum 20Y to the downstream photoconductive drum 20Bk in the rotation direction A1 of the transfer belt 11.

The photoconductive drums 20Y, 20C, 20M, and 20Bk are aligned in this order in the rotation direction A1 of the transfer belt 11. The photoconductive drums 20Y, 20C, 20M, and 20Bk are located in the image forming units that form the yellow, cyan, magenta, and black toner images, respectively.

The image forming apparatus 100 includes the four image forming units that form the yellow, cyan, magenta, and black toner images, respectively, a transfer belt unit 10, a secondary transfer roller 5, a transfer belt cleaner 13, and the optical writing device 8. The transfer belt unit 10 is situated above and disposed opposite the photoconductive drums 20Y, 20C, 20M, and 20Bk. The transfer belt unit 10 incorporates the transfer belt 11 and the primary transfer rollers 12Y, 12C, 12M, and 12Bk. The secondary transfer roller 5 is disposed opposite the transfer belt 11 and driven and rotated in accordance with rotation of the transfer belt 11. The transfer belt cleaner 13 is disposed opposite the transfer belt 11 to clean the transfer belt 11. The optical writing device 8 is situated below and disposed opposite the four image forming units.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20Bk thereto, forming electrostatic latent images on the photoconductive drums 20Y, 20C, 20M, and 20Bk, respectively. FIG. 1 illustrates the light beam Lb directed to the image forming unit that forms the black toner image. Similarly, light beams Lb are directed to the image forming units that form the yellow, cyan, and magenta toner images, respectively.

The image forming apparatus 100 further includes a sheet feeder 61 and a registration roller pair 4. The sheet feeder 61 incorporates a paper tray that loads a plurality of recording sheets S to be conveyed to a secondary transfer nip formed between the transfer belt 11 and the secondary transfer roller 5. The registration roller pair 4 conveys a recording sheet S conveyed from the sheet feeder 61 to the secondary transfer nip formed between the transfer belt 11 and the secondary transfer roller 5 at a predetermined time when the yellow, cyan, magenta, and black toner images superimposed on the transfer belt 11 reach the secondary transfer nip. The image forming apparatus 100 further includes a sensor for detecting that a leading edge of the recording sheet S reaches the registration roller pair 4.

The image forming apparatus 100 further includes a fixing device 200, an output roller pair 7, an output tray 17, and toner bottles 9Y, 9C, 9M, and 9Bk. The fixing device 200, serving as a fusing unit employing a belt fixing system, fixes a color toner image formed by the yellow, cyan, magenta, and black toner images secondarily transferred from the transfer belt 11 onto the recording sheet S thereon. The output roller pair 7 ejects the recording sheet S bearing the fixed toner image onto an outside of the image forming apparatus 100, that is, the output tray 17. The output tray 17 is disposed atop the image forming apparatus 100 and stacks the recording sheet S ejected by the output roller pair 7 to the outside of the image forming apparatus 100. The toner bottles 9Y, 9C, 9M, and 9Bk are situated below the output tray 17 and replenished with fresh yellow, cyan, magenta, and black toners, respectively.

The transfer belt unit 10 includes a driving roller 72 and a driven roller 73 over which the transfer belt 11 is looped, in addition to the transfer belt 11 and the primary transfer rollers 12Y, 12C, 12M, and 12Bk.

Since the driven roller 73 also serves as a tension applicator that applies tension to the transfer belt 11, a biasing member (e.g., a spring) biases the driven roller 73 against the transfer belt 11. The transfer belt unit 10, the primary transfer rollers 12Y, 12C, 12M, and 12Bk, the secondary transfer roller 5, and the transfer belt cleaner 13 construct a transfer device 71.

The sheet feeder 61 is situated in a lower portion of the image forming apparatus 100 and includes a feed roller 3 that contacts an upper side of an uppermost recording sheet S of the plurality of recording sheets S loaded on the paper tray of the sheet feeder 61. As the feed roller 3 is driven and rotated counterclockwise in FIG. 1, the feed roller 3 feeds the uppermost recording sheet S to the registration roller pair 4.

The transfer belt cleaner 13 of the transfer device 71 includes a cleaning brush and a cleaning blade being disposed opposite and contacting the transfer belt 11. The cleaning brush and the cleaning blade of the transfer belt cleaner 13 scrape a foreign substance such as residual toner particles off the transfer belt 11, removing the foreign substance from the transfer belt 11 and thereby cleaning the transfer belt 11.

The transfer belt cleaner 13 further includes a waste toner conveyer that conveys the residual toner particles removed from the transfer belt 11.

Figure 2:
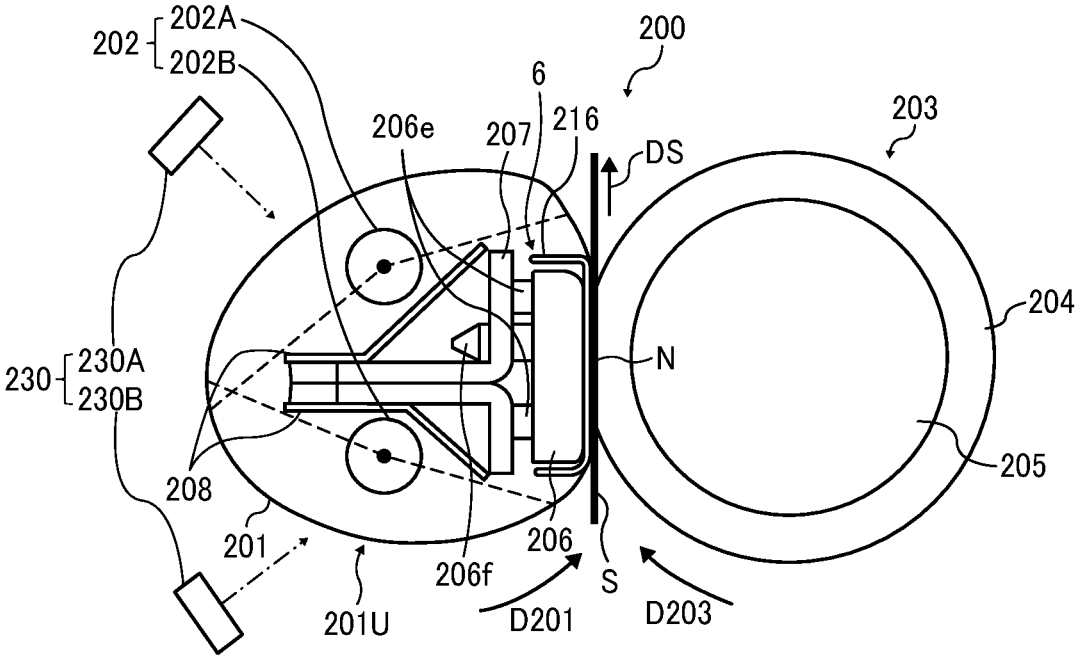
FIG. 2 is a schematic vertical cross-sectional view of a fixing device according to a first embodiment of the present disclosure, which is incorporated in the image forming apparatus depicted in FIG. 1.

Referring to FIG. 2, a description is provided of a construction of the fixing device 200 according to a first embodiment incorporated in the image forming apparatus 100 having the construction described above.

FIG. 2 is a schematic vertical cross-sectional view of the fixing device 200. As illustrated in FIG. 2, the fixing device 200 (e.g., a fuser or a fusing unit) includes a fixing belt 201 formed into a loop as one example of a fixing rotator or a fixing member rotatable in a rotation direction D201 and a pressure roller 203 as one example of a pressure rotator disposed opposite the fixing belt 201 and rotatable in a rotation direction D203. Each of the fixing belt 201 and the pressure roller 203 extends in a longitudinal direction, that is, an axial direction, which is perpendicular to a cross-section in FIG. 2. Each of the fixing belt 201 and the pressure roller 203 is greater than a width of the recording sheet S in the axial direction of the fixing belt 201 and the pressure roller 203. The fixing belt 201 and the pressure roller 203 sandwich and convey the recording sheet S. The fixing device 200 further includes a heater pair 202 as one example of a heater or a heat source. The heater pair 202 includes a center heater 202A and a lateral end heater 202B. The center heater 202A and the lateral end heater 202B are disposed opposite an inner circumferential surface of the fixing belt 201 to heat the fixing belt 201 directly with radiation heat. As described below, the center heater 202A and the lateral end heater 202B have different heat generation spans in the axial direction of the fixing belt 201, which heat different heating spans of the fixing belt 201 in the axial direction thereof, respectively. The heater pair 202 employs a halogen heater as one example. However, the heater pair 202 is not limited to the halogen heater. For example, the heater pair 202 is a ceramic heater that contacts and heats the fixing belt 201 or an induction heater (IH) that causes the fixing belt 201 to generate heat by electromagnetic induction.

The fixing device 200 further includes a temperature sensor pair 230 as one example of a temperature detector that detects the temperature of the fixing belt 201. The temperature sensor pair 230 employs a non-contact thermopile as one example. However, the temperature sensor pair 230 is not limited to the non-contact thermopile. As described below, the temperature sensor pair 230 includes two temperature sensors, that is, a center temperature sensor 230A and a lateral end temperature sensor 230B which are disposed opposite an outer circumferential surface of the fixing belt 201 at different positions, respectively, in the axial direction thereof. The temperature sensor pair 230 detects the temperature of the outer circumferential surface of the fixing belt 201. As described below, a controller 18 controls the lighting rate of the heater pair 202 according to the temperature of the fixing belt 201 detected by the temperature sensor pair 230, thus controlling the temperature of the fixing belt 201 to a desired temperature.

Inside the loop formed by the fixing belt 201 is a nip formation assembly 6 including a nip formation pad 206 and a thermal conduction aid 216. The nip formation assembly 6 is disposed opposite the pressure roller 203 via the fixing belt 201 to form a fixing nip N between the fixing belt 201 and the pressure roller 203. For example, the nip formation assembly 6 and the pressure roller 203 sandwich the fixing belt 201 to form the fixing nip N between the fixing belt 201 and the pressure roller 203. While a recording sheet S bearing a toner image is conveyed through the fixing nip N in a recording sheet conveyance direction DS, the toner image on the recording sheet S receives sufficient heat and pressure from the fixing belt 201 and the pressure roller 203, thus being fixed on the recording sheet S. The nip formation pad 206 contacts the thermal conduction aid 216. The thermal conduction aid 216 includes an inner face that contacts the nip formation pad 206 and an outer face that is opposite the inner face and contacts the inner circumferential surface of the fixing belt 201. The fixing belt 201 rotates in the rotation direction D201 while the fixing belt 201 contacts and slides over the thermal conduction aid 216.

A description is provided of a configuration of the controller 18.

Figure 3:
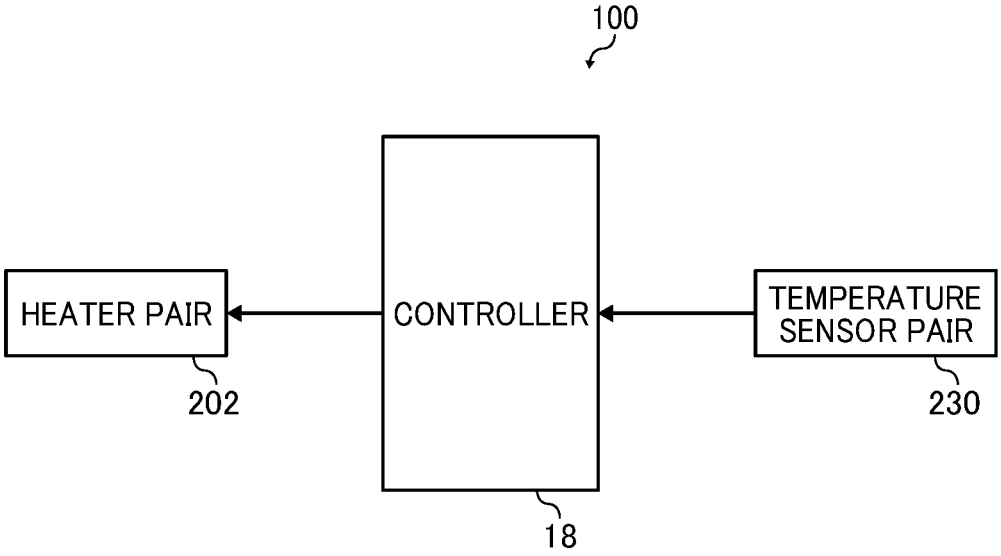
FIG. 3 is a block diagram of the image forming apparatus depicted in FIG. 1, illustrating a controller incorporated therein.

FIG. 3 is a block diagram of the image forming apparatus 100, illustrating the controller 18 for controlling the temperature of the fixing belt 201 as described above. The controller 18 (e.g., a processor) is a micro computer including a central processing unit (CPU), a read only memory (ROM), and a random access memory (RAM). The controller 18 controls power supply to the heater pair 202 based on the temperature of the fixing belt 201 detected by the temperature sensor pair 230. For example, based on information about the temperature of the fixing belt 201 which is sent from each of the center temperature sensor 230A and the lateral end temperature sensor 230B, the controller 18 controls power supply to each of the center heater 202A and the lateral end heater 202B, that is, the halogen heater, through a triac or the like, thus performing a feedback control that adjusts the lighting rate of the center heater 202A and the lateral end heater 202B. The controller 18, as one example, is disposed inside a body of the image forming apparatus 100 to control components other than the fixing device 200 that are disposed inside the image forming apparatus 100 and control communication between the image forming apparatus 100 and an external device. The controller 18 may be located in the fixing device 200 or the image forming apparatus 100.

A detailed description is now given of a configuration of the thermal conduction aid 216.

As illustrated in FIG. 2, the outer face of the thermal conduction aid 216 that is disposed opposite the pressure roller 203 is planar. Alternatively, the outer face of the thermal conduction aid 216 may not be planar. For example, the outer face of the thermal conduction aid 216 may be contoured into a recess or a curve corresponding to an outer circumferential surface of the pressure roller 203 or other shapes. If the outer face of the thermal conduction aid 216 is recessed with respect to the pressure roller 203, the outer face of the thermal conduction aid 216 directs the leading edge of the recording sheet S toward the pressure roller 203 as the recording sheet S is ejected from the fixing nip N, facilitating separation of the recording sheet S from the fixing belt 201 and suppressing jamming of the recording sheet S between the fixing belt 201 and the pressure roller 203.

Inside the loop formed by the fixing belt 201 are the nip formation pad 206, the thermal conduction aid 216, and a stay 207. The nip formation pad 206 is disposed opposite the pressure roller 203. The thermal conduction aid 216 covers an outer face of the nip formation pad 206 that is disposed opposite the inner circumferential surface of the fixing belt 201. The stay 207 supports the nip formation pad 206 against pressure from the pressure roller 203. Each of the nip formation pad 206, the thermal conduction aid 216, and the stay 207 has a length not smaller than a length of the fixing belt 201 in the axial direction thereof that is parallel to a longitudinal direction of the nip formation pad 206, the thermal conduction aid 216, and the stay 207. Each of the nip formation pad 206, the thermal conduction aid 216, and the stay 207 has a length not smaller than a length of the fixing nip N in the recording sheet conveyance direction DS that is substantially perpendicular to the axial direction of the fixing belt 201 and parallel to a short direction of the nip formation pad 206, the thermal conduction aid 216, and the stay 207.

The thermal conduction aid 216 prevents heat conducted to the fixing belt 201 from being stored locally and facilitates conduction of heat in the longitudinal direction of the thermal conduction aid 216, thus reducing uneven temperature of the fixing belt 201 in the axial direction thereof. Hence, the thermal conduction aid 216 is made of a material that conducts heat quickly, for example, a metal material having an increased thermal conductivity such as copper, aluminum, and silver. It is preferable that the thermal conduction aid 216 is made of copper in a comprehensive view of manufacturing costs, availability, thermal conductivity, and processing. Thus, the thermal conduction aid 216 is a metal plate, for example.

According to this embodiment, at least a part of the outer face of the thermal conduction aid 216 that is disposed opposite the inner circumferential surface of the fixing belt 201 contacts the inner circumferential surface of the fixing belt 201 directly, thus serving as a nip formation face that forms the fixing nip N.

A detailed description is now given of a construction of the fixing belt 201.

The fixing belt 201 is an endless belt or film made of metal such as nickel and SUS stainless steel or resin such as polyimide, for example. The fixing belt 201 includes a base layer and a surface layer. The surface layer is made of polytetrafluoroethylene-perfluoroalkylvinylether copolymer (PFA), polytetrafluoroethylene (PTFE), or the like to prevent toner of the toner image on the recording sheet S from adhering to the fixing belt 201. An elastic layer may be sandwiched between the base layer and the surface layer and made of silicone rubber or the like. If the fixing belt 201 does not incorporate the elastic layer, the fixing belt 201 has a decreased thermal capacity that improves fixing property of being heated quickly to a desired fixing temperature at which the toner image is fixed on the recording sheet S properly. However, as the pressure roller 203 and the fixing belt 201 sandwich and press the unfixed toner image on the recording sheet S passing through the fixing nip N, slight surface asperities of the fixing belt 201 may be transferred onto the toner image on the recording sheet S, resulting in variation in gloss of the solid toner image. To address this circumstance, the elastic layer has a thickness not smaller than 100 micrometers. As the elastic layer deforms, the elastic layer absorbs slight surface asperities of the fixing belt 201, preventing variation in gloss of the solid toner image.

A detailed description is now given of a construction of the stay 207.

The stay 207 includes an arm extending in a direction in which the arm separates from the fixing nip N. The center heater 202A is disposed opposite the lateral end heater 202B via the arm of the stay 207. The center heater 202A and the lateral end heater 202B serve as a fixing heater. The center heater 202A and the lateral end heater 202B emit light that irradiates the inner circumferential surface of the fixing belt 201, thus heating the fixing belt 201 directly with radiation heat.

The stay 207 serving as a support that supports the nip formation pad 206 to form the fixing nip N is situated inside the loop formed by the fixing belt 201. As the nip formation pad 206 receives pressure from the pressure roller 203, the stay 207 supports the nip formation pad 206 to prevent bending of the nip formation pad 206 and produce an even nip length in the recording sheet conveyance direction DS throughout the entire span of the fixing belt 201 in the axial direction thereof. The nip formation pad 206 includes projections 206*e* contacting the stay 207. The projections 206*e* are extended in the longitudinal direction of the nip formation pad 206 and arranged in two rows. FIG. 2 illustrates the two projections 206*e* disposed at a lateral end of the nip formation pad 206 in the longitudinal direction thereof. If an outer face of the stay 207 surface-contacts an inner face of the nip formation pad 206, heat may accumulate between the outer face of the stay 207 and the inner face of the nip formation pad 206, resulting in a failure such as deformation of the nip formation pad 206. To address this circumstance, according to this embodiment, the outer face of the stay 207 contacts the projections 206*e* of the nip formation pad 206, preventing heat from accumulating between the stay 207 and the nip formation pad 206. The nip formation pad 206 further includes a boss 206*f*. The stay 207 includes a boss hole through which the boss 206*f* is inserted to position the nip formation pad 206 with respect to the stay 207.

A detailed description is now given of a configuration of the nip formation pad 206.

The nip formation pad 206 is made of a heat resistant material being resistant against temperatures up to a range of from 200 degrees centigrade to 400 degrees centigrade, preferably a range of from 200 degrees centigrade to 350 degrees centigrade, and having an enhanced mechanical strength. For example, the nip formation pad 206 is made of heat resistant resin such as polyimide (PI), polyether ether ketone (PEEK), and PI or PEEK reinforced with glass fiber.

The stay 207 is mounted on and held by flanges 209 described below as a holder at both lateral ends of the stay 207 in the longitudinal direction thereof, thus being positioned inside the fixing device 200. A reflector 208 is interposed between the center heater 202A and the stay 207 and between the lateral end heater 202B and the stay 207. The reflector 208 prevents light and heat radiated from the heater pair 202 from heating the stay 207 with radiant heat, suppressing waste of energy. Alternatively, instead of the reflector 208, an opposed face of the stay 207 disposed opposite the heater pair 202 may be treated with insulation or mirror finish to reflect light radiated from the heater pair 202 to the stay 207 toward the fixing belt 201. The stay 207 is made of a material enhancing the mechanical strength to support the nip formation pad 206 against pressure from the pressure roller 203 and prevent bending of the nip formation pad 206. For example, the stay 207 is made of metal such as stainless steel and iron or resin.

A detailed description is now given of a construction of the pressure roller 203.

The pressure roller 203 is constructed of a core bar 205, an elastic rubber layer 204 coating the core bar 205, and a release layer coating the elastic rubber layer 204. The elastic rubber layer 204 is made of rubber. The release layer is made of PFA or PTFE, for example, to facilitate separation of the recording sheet S from the pressure roller 203. As a driving force generated by a driver (e.g., a motor) situated inside the image forming apparatus 100 depicted in FIG. 1 is transmitted to the pressure roller 203 through a gear train, the pressure roller 203 rotates in the rotation direction D203. Alternatively, the driver may also be connected to the fixing belt 201 to drive and rotate the fixing belt 201. A spring or the like presses the pressure roller 203 against the nip formation pad 206 via the fixing belt 201. As the spring presses and deforms the elastic rubber layer 204 of the pressure roller 203, the pressure roller 203 produces and retains the fixing nip N having a predetermined length in the recording sheet conveyance direction DS. The pressure roller 203 may be a hollow roller or a solid roller. If the pressure roller 203 is a hollow roller, a heater such as a halogen heater may be disposed inside the hollow roller. The elastic rubber layer 204 may be made of solid rubber. Alternatively, if no heater is situated inside the pressure roller 203, the elastic rubber layer 204 may be made of sponge rubber. The sponge rubber is more preferable than the solid rubber because the sponge rubber has an increased insulation that draws less heat from the fixing belt 201.

As the pressure roller 203 rotates in the rotation direction D203, the fixing belt 201 rotates in the rotation direction D201 in accordance with rotation of the pressure roller 203 by friction therebetween. According to this embodiment, as the driver drives and rotates the pressure roller 203, a driving force of the driver is transmitted from the pressure roller 203 to the fixing belt 201 at the fixing nip N, thus rotating the fixing belt 201 by friction between the pressure roller 203 and the fixing belt 201. At the fixing nip N, the fixing belt 201 rotates as the fixing belt 201 is sandwiched between the pressure roller 203 and the nip formation pad 206; at a circumferential span of the fixing belt 201 other than the fixing nip N, the fixing belt 201 rotates while the fixing belt 201 is guided by the flange 209 described below at each lateral end of the fixing belt 201 in the axial direction thereof.

The fixing belt 201 and the components disposed inside the loop formed by the fixing belt 201, that is, the heater pair 202, the nip formation assembly 6, the stay 207, and the reflector 208, may construct a belt unit 201U that is coupled with the pressure roller 203. With the construction described above, the fixing device 200 attaining quick warm-up is manufactured at reduced costs.

A description is provided of the length of the thermal conduction aid 216 incorporated in the fixing device 200 in the longitudinal direction of the thermal conduction aid 216.

The length of the pressure roller 203 in the axial direction thereof is greater than a maximum conveyance span of 320 mm as one example where a maximum recording sheet S available in the fixing device 200 is conveyed in view of shifting of the recording sheet S when a user places the recording sheet S inside the sheet feeder 61 erroneously. The length of the thermal conduction aid 216 in the longitudinal direction thereof is greater than the length of the pressure roller 203 in the axial direction thereof. If the length of the thermal conduction aid 216 is smaller than the length of the pressure roller 203, the fixing belt 201 may bend at a lateral end of the thermal conduction aid 216 in the longitudinal direction thereof at the fixing nip N and therefore may be damaged. To address this circumstance, the length of the thermal conduction aid 216 is greater than the length of the pressure roller 203 in view of manufacturing tolerance of each component of the fixing device 200 and play required for assembling. Accordingly, the length of the thermal conduction aid 216 is substantially greater than the maximum conveyance span of the fixing device 200. For example, the length of the thermal conduction aid 216 is greater than the maximum conveyance span by about 20 mm at each lateral end of the thermal conduction aid 216 in the longitudinal direction thereof.

A description is provided of a construction of a fixing device 200S according to a second embodiment.

Figure 4:
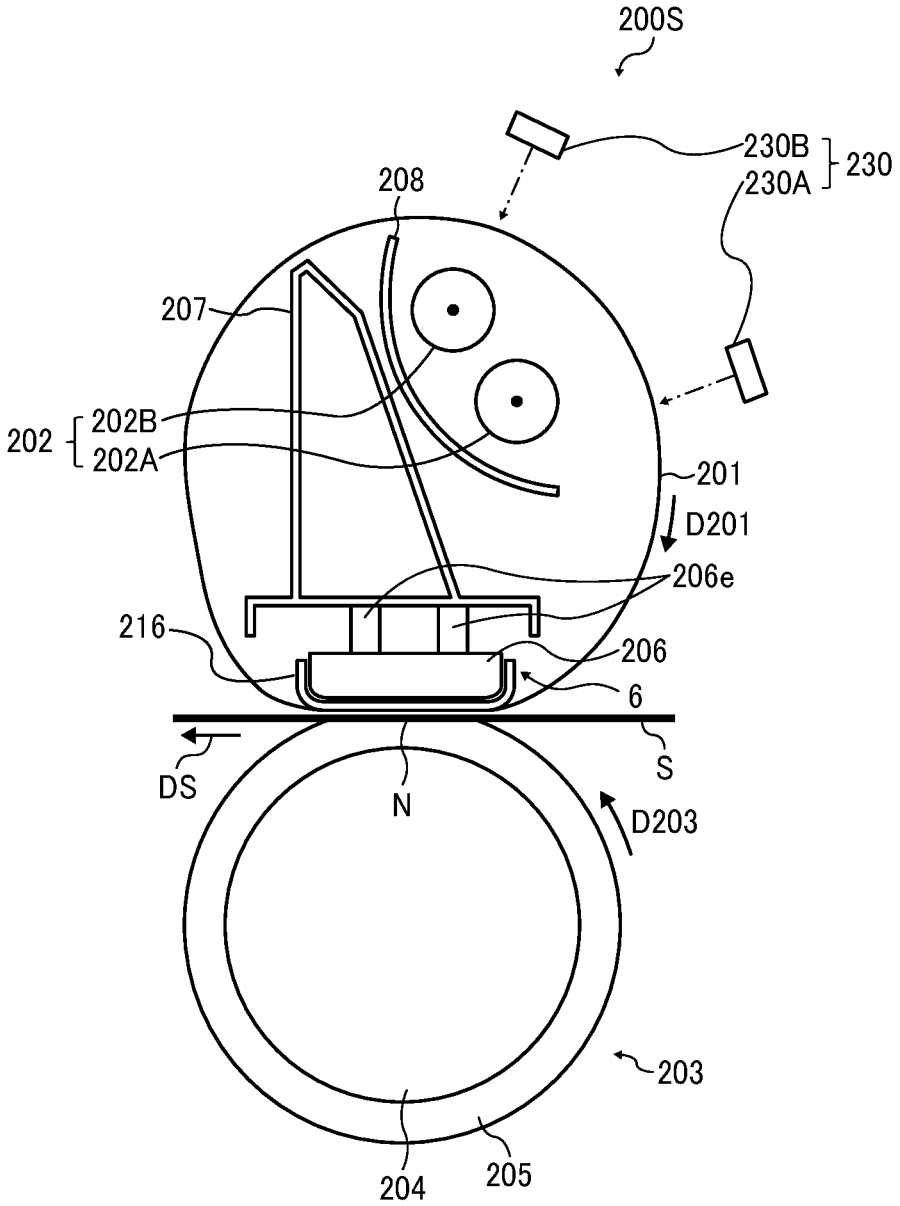
FIG. 4 is a schematic vertical cross-sectional view of a fixing device according to a second embodiment of the present disclosure.

FIG. 4 is a schematic vertical cross-sectional view of the fixing device 200S. Identical reference numerals are assigned to components identical or equivalent to the components incorporated in the fixing device 200 illustrated in FIG. 2. In the fixing device 200 according to the first embodiment depicted in FIG. 2, the stay 207 is interposed between the center heater 202A and the lateral end heater 202B. Conversely, in the fixing device 200S according to the second embodiment depicted in FIG. 4, the center heater 202A and the lateral end heater 202B are disposed upstream from the fixing nip N in the rotation direction D201 of the fixing belt 201.

As illustrated in FIG. 2, the stay 207 interposed between the center heater 202A and the lateral end heater 202B screens the center heater 202A from the lateral end heater 202B and screens the lateral end heater 202B from the center heater 202A. Accordingly, the stay 207 prevents heat radiated from one of the center heater 202A and the lateral end heater 202B from being absorbed by a glass tube or the like of another one of the center heater 202A and the lateral end heater 202B, reducing waste of energy. As illustrated in FIG. 4, the center heater 202A and the lateral end heater 202B are disposed upstream from the fixing nip N in the rotation direction D201 of the fixing belt 201. Accordingly, a heated portion of the fixing belt 201 heated by the center heater 202A and the lateral end heater 202B dissipates a reduced amount of heat before the heated portion of the fixing belt 201 reaches the fixing nip N as the fixing belt 201 rotates in the rotation direction D201, reducing waste of energy. Thus, the fixing device 200 is modified variously.

Figure 5:
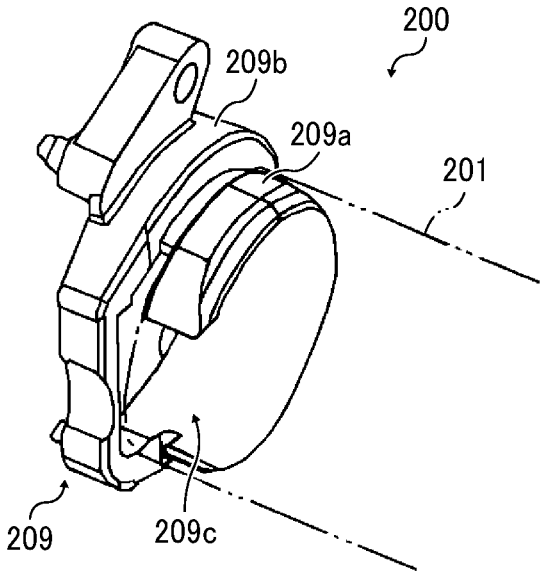
FIG. 5 is a schematic perspective view of the fixing device depicted in FIG. 2, illustrating one lateral end of the fixing device in a longitudinal direction thereof.

FIG. 5 is a schematic perspective view of the fixing device 200, illustrating one lateral end of the fixing device 200 in a longitudinal direction thereof. The flange 209 is disposed at each lateral end of the fixing belt 201 in the axial direction thereof. FIG. 5 illustrates the flange 209 disposed at one lateral end of the fixing belt 201 in the axial direction thereof.

The flange 209 is hollow and open at each lateral end thereof in the axial direction of the fixing belt 201. The flange 209 includes a receiver 209*a* extending in the axial direction of the fixing belt 201 and a flange portion 209*b* projecting in a radial direction of the fixing belt 201 from the receiver 209*a* and being molded with the receiver 209*a*. The receiver 209*a* includes a slit 209*c* at a part of the receiver 209*a* in a circumferential direction of the fixing belt 201 and is partially cylindrical or tubular. The nip formation pad 206 and the thermal conduction aid 216 are inserted into a space defined by the slit 209*c*.

If the fixing belt 201 is skewed in the axial direction of the fixing belt 201, a lateral end of the fixing belt 201 in the axial direction thereof comes into contact with the receiver 209*a* that restricts motion of the fixing belt 201 in the axial direction thereof. The flange portion 209*b* is supported by a side plate of the fixing device 200. Optionally, a plate ring may be interposed between the receiver 209*a* and each lateral end of the fixing belt 201 in the axial direction thereof. The plate ring is made of a material that facilitates sliding of the fixing belt 201 over the plate ring.

A description is provided of a configuration of the nip formation pad 206 and the thermal conduction aid 216 of the nip formation assembly 6 according to a first embodiment.

Figure 6:
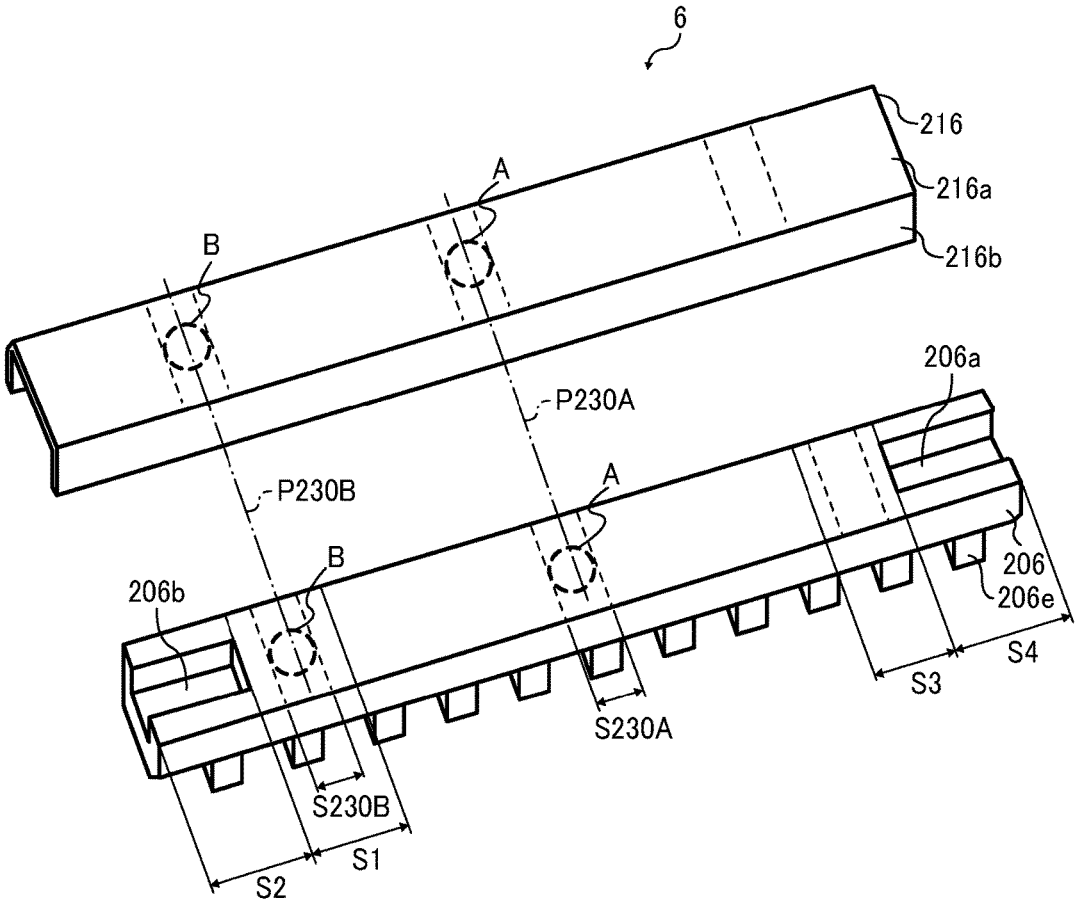
FIG. 6 is an exploded perspective view of a nip formation assembly according to a first embodiment of the present disclosure, which is incorporated in the fixing device depicted in FIG. 2.

FIG. 6 is an exploded perspective view of the nip formation assembly 6 according to the first embodiment. The center temperature sensor 230A depicted in FIGS. 2 and 4 is disposed opposite the fixing belt 201 at a position P230A indicated with alternate long and short dash lines and detects the temperature of the outer circumferential surface of the fixing belt 201 in a center detection span S230A in the axial direction of the fixing belt 201. The lateral end temperature sensor 230B depicted in FIGS. 2 and 4 is disposed opposite the fixing belt 201 at a position P230B indicated with alternate long and short dash lines and detects the temperature of the outer circumferential surface of the fixing belt 201 in a lateral end detection span S230B in the axial direction of the fixing belt 201.

For example, after the nip formation pad 206 and the thermal conduction aid 216 are installed in the fixing device 200 or 200S and the fixing device 200 or 200S starts operation, as illustrated in FIGS. 2 and 4, as the fixing belt 201 rotates in the rotation direction D201, the inner circumferential surface of the fixing belt 201 contacts and slides over the thermal conduction aid 216. At the position P230A, the center temperature sensor 230A detects the temperature of the outer circumferential surface of the fixing belt 201 and the inner circumferential surface of the fixing belt 201 contacts and slides over the outer face of the thermal conduction aid 216 while the fixing belt 201 rotates in the rotation direction D201. At the position P230B, the lateral end temperature sensor 230B detects the temperature of the outer circumferential surface of the fixing belt 201 and the inner circumferential surface of the fixing belt 201 contacts and slides over the outer face of the thermal conduction aid 216 while the fixing belt 201 rotates in the rotation direction D201. At the positions P230A and P230B, the inner face of the thermal conduction aid 216 contacts the outer face of the nip formation pad 206.

As one example, the center temperature sensor 230A has a center detection region A indicated with a dotted circle. The lateral end temperature sensor 230B has a lateral end detection region B indicated with a dotted circle. As the fixing belt 201 rotates, the center temperature sensor 230A and the lateral end temperature sensor 230B detect the temperature of the outer circumferential surface of the fixing belt 201 in the center detection span S230A defined by the position P230A as a center and the lateral end detection span S230B defined by the position P230B as a center, respectively. While the fixing belt 201 rotates, the inner circumferential surface of the fixing belt 201 contacts the thermal conduction aid 216 in the center detection span S230A and the lateral end detection span S230B. As described above, the center temperature sensor 230A and the lateral end temperature sensor 230B detect the temperature of the fixing belt 201 at the positions P230A and P230B, respectively. However, the center temperature sensor 230A and the lateral end temperature sensor 230B may not be disposed opposite the positions P230A and P230B on the fixing belt 201, respectively. For example, if each of the center temperature sensor 230A and the lateral end temperature sensor 230B is a non-contact sensor isolated from the fixing belt 201, the center temperature sensor 230A and the lateral end temperature sensor 230B may be shifted from the positions P230A and P230B, respectively, due to a layout of the fixing device 200.

The thermal conduction aid 216 includes a nip formation portion 216*a* and a bent portion 216*b*. The thermal conduction aid 216 extends in the longitudinal direction thereof and covers the outer face of the nip formation pad 206 that is disposed opposite the fixing nip N. When seen in a cross-section depicted in FIGS. 2 and 4 that is perpendicular to the longitudinal direction of the thermal conduction aid 216, the nip formation portion 216*a* is contoured along the outer face of the nip formation pad 206. The nip formation portion 216*a* contacts the outer face of the nip formation pad 206 that faces the fixing nip N via the thermal conduction aid 216 and the fixing belt 201. The nip formation portion 216*a* includes an inner face that contacts the nip formation pad 206 and an outer face that is opposite the inner face and contacts the inner circumferential surface of the fixing belt 201.

The bent portion 216*b* is bent relative to the nip formation portion 216*a* at substantially a right angle. While the fixing belt 201 rotates, friction between the fixing belt 201 and the thermal conduction aid 216 may generate a force that shifts the thermal conduction aid 216 from the nip formation pad 206 in the recording sheet conveyance direction DS. To address this circumstance, the bent portion 216*b* contacts the nip formation pad 206 to prevent the thermal conduction aid 216 from shifting from the nip formation pad 206 in the recording sheet conveyance direction DS, retaining a proper positional relation between the thermal conduction aid 216 and the nip formation pad 206.

The nip formation pad 206 includes grooves 206*a* and 206*b* (e.g., recesses) on the outer face that contacts the thermal conduction aid 216, decreasing the contact area where the nip formation pad 206 contacts the thermal conduction aid 216. The groove 206*a* originates at one lateral edge of the nip formation pad 206 and extends toward a center of the nip formation pad 206 in the longitudinal direction thereof. The groove 206*b* originates at another lateral edge of the nip formation pad 206 and extends toward the center of the nip formation pad 206 in the longitudinal direction thereof. However, the groove 206*b* does not extend to the lateral end detection span S230B, encompassing the position P230B, where the lateral end temperature sensor 230B detects the temperature of the fixing belt 201 so as to increase the contact area where the nip formation pad 206 contacts the thermal conduction aid 216.

As one example, the groove 206*b* originates at one lateral edge of the nip formation pad 206 and extends to a position outboard from the position P230B of the lateral end temperature sensor 230B by 10 mm in the longitudinal direction of the nip formation pad 206. The groove 206*a* originates at another lateral edge of the nip formation pad 206 in the longitudinal direction thereof. The groove 206*a* defines an outboard span S4 disposed outboard from a symmetrical span S3 that is substantially symmetrical to a first span S1 encompassing the lateral end detection span S230B via a center of the fixing belt 201 in the axial direction thereof. In the symmetrical span S3, the nip formation pad 206 contacts the thermal conduction aid 216 in a contact area which is greater than a contact area where the nip formation pad 206 contacts the thermal conduction aid 216 in the outboard span S4. According to this embodiment, the groove 206*a* is substantially symmetrical to the groove 206*b* via the center of the nip formation pad 206 in the longitudinal direction thereof. Each of the grooves 206*a* and 206*b* is disposed at substantially a center of the nip formation pad 206 in the short direction thereof and has an identical width in the short direction of the nip formation pad 206.

A description is provided of a configuration of a nip formation pad 206S and the thermal conduction aid 216 of a nip formation assembly 6S according to a second embodiment.

Figure 7:
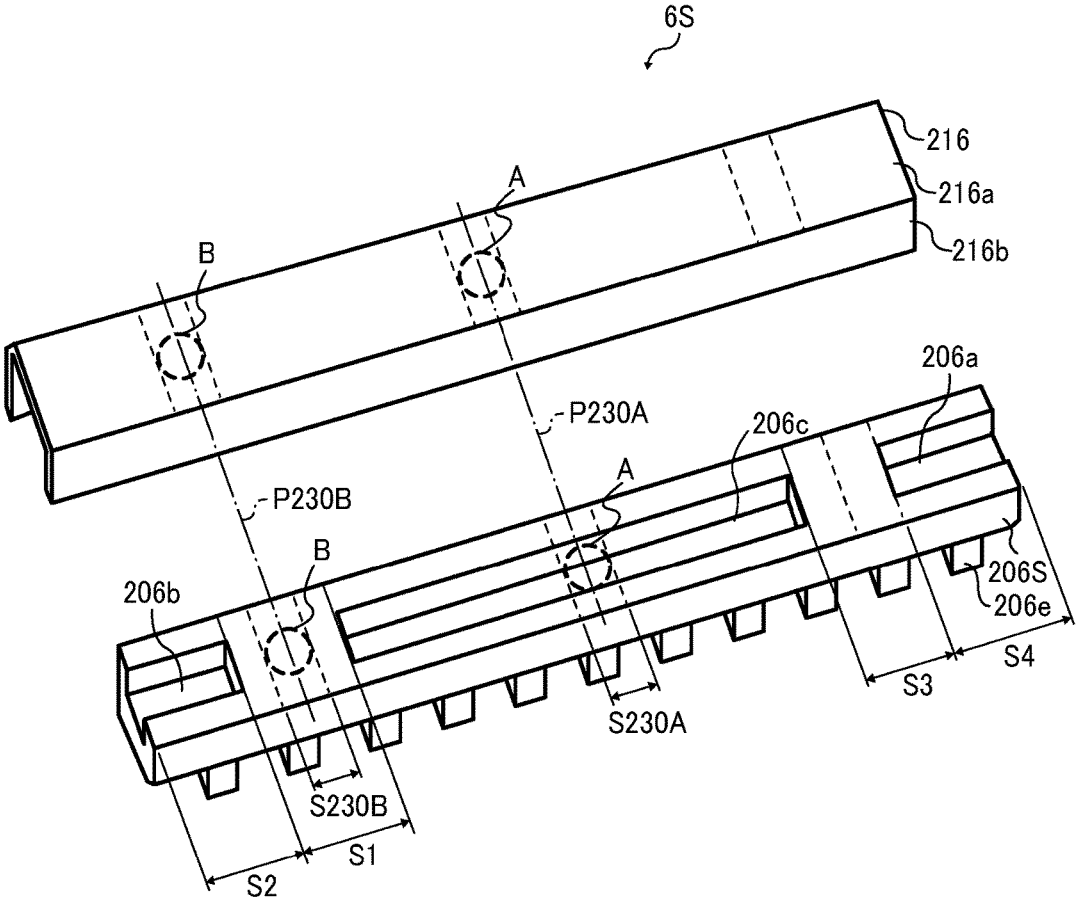
FIG. 7 is an exploded perspective view of a nip formation assembly according to a second embodiment of the present disclosure, which is installable in the fixing device depicted in FIG. 2.

FIG. 7 is an exploded perspective view of the nip formation assembly 6S according to the second embodiment. The nip formation pad 206S depicted in FIG. 7 includes a groove 206*c* disposed at a center of the nip formation pad 206S in a longitudinal direction thereof and not disposed at both lateral end portions where the grooves 206*a* and 206*b* are not disposed on the nip formation pad 206 depicted in FIG. 6. As one example, the grooves 206*b* and 206*c* are not disposed in an intermediate span (e.g., the first span S1) that extends inboard and outboard from the position P230B by 10 mm in the longitudinal direction of the nip formation pad 206S. The grooves 206*a*, 206*b*, and 206*c* are disposed outside the intermediate span, varying the contact area where the nip formation pad 206S contacts the thermal conduction aid 216 in the longitudinal direction of the nip formation pad 206S. The groove 206*c* decreases an amount of heat diffused from the thermal conduction aid 216 to the nip formation pad 206S in a center span of the nip formation pad 206S in the longitudinal direction thereof, allowing the thermal conduction aid 216 to conduct heat to the fixing belt 201 effectively to fix the toner image on the recording sheet S at the fixing nip N.

A description is provided of a configuration of a nip formation pad 206T and the thermal conduction aid 216 of a nip formation assembly 6T according to a third embodiment.

Figure 8:
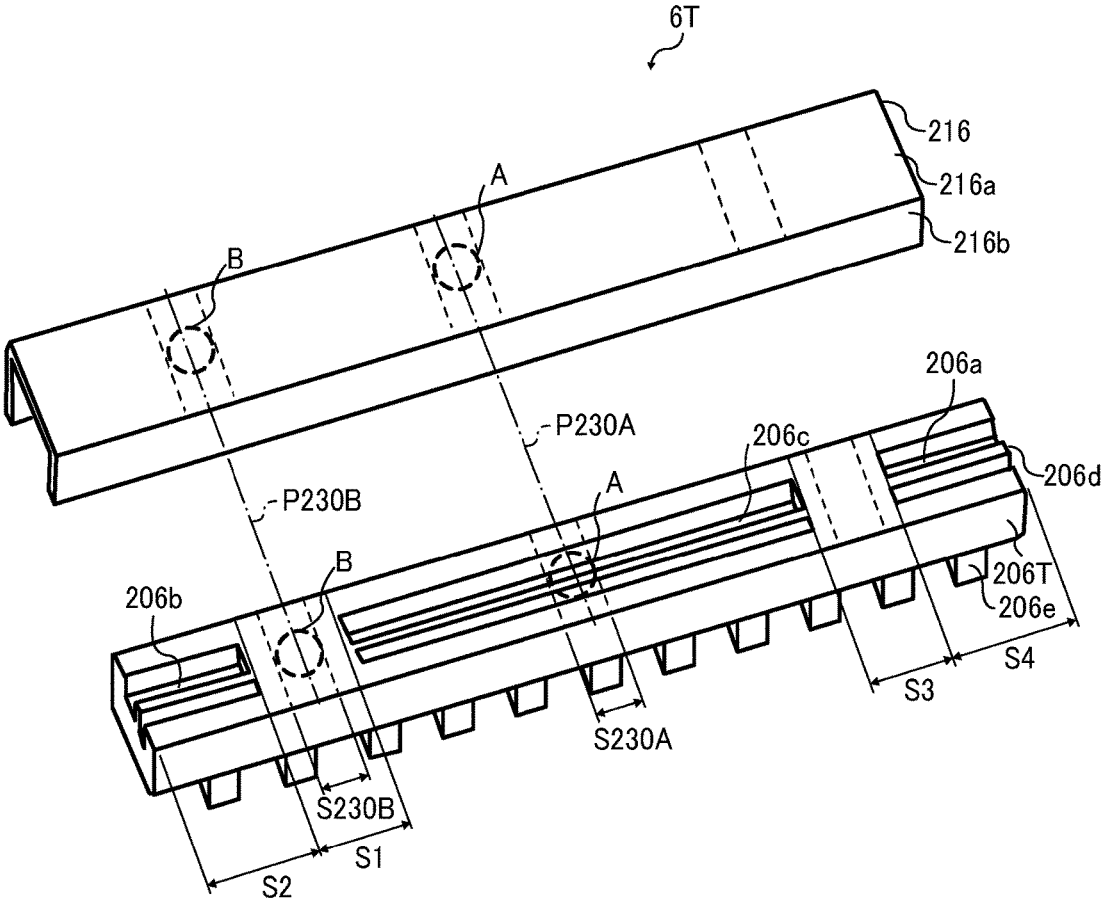
FIG. 8 is an exploded perspective view of a nip formation assembly according to a third embodiment of the present disclosure, which is installable in the fixing device depicted in FIG. 2.

FIG. 8 is an exploded perspective view of the nip formation assembly 6T according to the third embodiment. The nip formation pad 206T depicted in FIG. 8 includes a beam 206*d* disposed at a center of each of the grooves 206*a*, 206*b*, and 206*c* in the rotation direction D201 of the fixing belt 201 and extended in a longitudinal direction of the nip formation pad 206T. In other words, the beam 206*d* divides each of the grooves 206*a*, 206*b*, and 206*c* into a plurality of groove portions. The beam 206*d* stabilizes pressure exerted at the fixing nip N to fix the toner image on the recording sheet S. The number of the beams 206*d* may increase. In order to enhance insulation and stabilize pressure exerted at the fixing nip N, the number of the beams 206*d* may vary between the grooves 206*a*, 206*b*, and 206*c*. For example, if the beams 206*d* have identical lengths in the longitudinal direction and a short direction of the nip formation pad 206T, the number of the beams 206*d* disposed on the groove 206*c* is greater than the number of the beams 206*d* disposed on each of the grooves 206*a* and 206*b*, thus increasing the contact area where the nip formation pad 206T contacts the thermal conduction aid 216.

The contact area where the nip formation pad 206T contacts the thermal conduction aid 216 is compared as below as one example. Sample regions having an identical area are extracted from an outer face of the nip formation pad 206T that is disposed opposite the thermal conduction aid 216. A sample region where one or more of the grooves 206*a*, 206*b*, and 206*c* occupy a smaller area creates a greater contact area where the nip formation pad 206T contacts the thermal conduction aid 216. In order to compare the contact area in the longitudinal direction of the nip formation pad 206T, since the outer face of the nip formation pad 206T that is disposed opposite the thermal conduction aid 216 is substantially rectangular, sample regions having a particular unit length in the longitudinal direction of the nip formation pad 206T are extracted to compare the rate of one or more of the grooves 206*a*, 206*b*, and 206*c* that occupy in each of the sample regions.

Referring to FIG. 7, a description is provided of a first comparison example of comparing the contact area described above.

A first region is defined by a span inboard and outboard from the position P230B by 10 mm, that is, a substantially rectangular region having a span of 20 mm in the longitudinal direction of the nip formation pad 206S. The grooves 206*b* and 206*c* are not disposed in the first region and the lateral end temperature sensor 230B is disposed in the first region. A second region is disposed outboard from the first region in the longitudinal direction of the nip formation pad 206S and has a span of 20 mm like the first region. Since the groove 206*b* is disposed in the second region, the first region attains a greater contact area where the nip formation pad 206S contacts the thermal conduction aid 216 compared to the second region.

Referring to FIG. 7, a description is provided of a second comparison example of comparing the contact area described above.

A first region is defined by a span inboard and outboard from the position P230B by 5 mm, that is, a substantially rectangular region having a span of 10 mm in the longitudinal direction of the nip formation pad 206S. The lateral end temperature sensor 230B is disposed in the first region. A second region is disposed outboard from the first region in the longitudinal direction of the nip formation pad 206S and has a span of 10 mm like the first region. Since the groove 206*b* is disposed in the second region, the first region attains a greater contact area where the nip formation pad 206S contacts the thermal conduction aid 216 compared to the second region. The second region having the span of 10 mm is selected contiguously in a region outboard from the first region in the longitudinal direction of the nip formation pad 206S. However, if the groove 206*b* is disposed in the second region, the first region attains a greater contact area where the nip formation pad 206S contacts the thermal conduction aid 216 compared to the second region, thus achieving advantages of this embodiment.

Each of the nip formation pads 206, 206S, and 206T contacts the thermal conduction aid 216 such that heat conduction generates between each of the nip formation pads 206, 206S, and 206T and the thermal conduction aid 216 at least in a pressurization direction in which pressure is exerted to fix the toner image on the recording sheet S. For example, even if an intermediate component is interposed between each of the nip formation pads 206, 206S, and 206T and the thermal conduction aid 216 and the intermediate component prohibits each of the nip formation pads 206, 206S, and 206T from contacting the thermal conduction aid 216 directly, if the intermediate component has an increased thermal conductivity and a decreased thermal capacity, each of the nip formation pads 206, 206S, and 206T attains the advantages described above. The grooves 206*a*, 206*b*, and 206*c* depicted in FIGS. 6 to 8 are filled with air. Alternatively, the grooves 206*a*, 206*b*, and 206*c* may be filled with a component made of a material that is different from a material of the nip formation pads 206, 206S, and 206T and has a thermal conductivity smaller than a thermal conductivity of the nip formation pads 206, 206S, and 206T. In this case also, the contact area where each of the nip formation pads 206, 206S, and 206T contacts the thermal conduction aid 216 varies depending on the position on each of the nip formation pads 206, 206S, and 206T in the longitudinal direction thereof.

As illustrated in FIGS. 6 to 8, each of the grooves 206*a*, 206*b*, and 206*c* is substantially parallel to the longitudinal direction of the nip formation pads 206, 206S, and 206T. Alternatively, each of the grooves 206*a*, 206*b*, and 206*c* may be angled or inclined relative to the longitudinal direction of the nip formation pads 206, 206S, and 206T. The grooves 206*a* and 206*b* originate at one lateral edge and another lateral edge of each of the nip formation pads 206, 206S, and 206T in the longitudinal direction thereof, respectively. Alternatively, the grooves 206*a* and 206*b* may be spaced apart from one lateral edge and another lateral edge of each of the nip formation pads 206, 206S, and 206T in the longitudinal direction thereof, respectively. Each of the grooves 206*a* and 206*b* does not originate at one lateral edge of each of the nip formation pads 206, 206S, and 206T in a short direction thereof. Alternatively, each of the grooves 206*a* and 206*b* may originate at and extend from one lateral edge of each of the nip formation pads 206, 206S, and 206T in the longitudinal direction thereof.

As illustrated in FIGS. 6 to 8, the nip formation pad 206 mounts the grooves 206*a* and 206*b* and each of the nip formation pads 206S and 206T mounts the grooves 206*a*, 206*b*, and 206*c*. The grooves 206*a*, 206*b*, and 206*c* may be replaced with cavities having a circular shape or other shapes to vary the contact area where each of the nip formation pads 206, 206S, and 206T contacts the thermal conduction aid 216 depending on the position on each of the nip formation pads 206, 206S, and 206T in the longitudinal direction thereof. The grooves 206*a*, 206*b*, and 206*c* are isolated from each other in the longitudinal direction of the nip formation pads 206, 206S, and 206T to adjust the contact area where each of the nip formation pads 206, 206S, and 206T contacts the thermal conduction aid 216.

Alternatively, the grooves 206*a*, 206*b*, and 206*c* or the cavities may be disposed throughout the entire span, including the lateral end detection region B, of the nip formation pads 206, 206S, and 206T in the longitudinal direction thereof. In this case, the width of each of the grooves 206*a*, 206*b*, and 206*c* in the short direction of the nip formation pads 206, 206S, and 206T, the size of each of the grooves 206*a*, 206*b*, and 206*c* or the cavities, and the density of the grooves 206*a*, 206*b*, and 206*c* or the cavities may vary. Even if the number, the size, and the density of the grooves 206*a*, 206*b*, and 206*c* or the cavities are identical, pressure with which each of the nip formation pads 206, 206S, and 206T contacts the thermal conduction aid 216 may vary. In this case also, the contact area where each of the nip formation pads 206, 206S, and 206T contacts the thermal conduction aid 216 varies depending on the position on each of the nip formation pads 206, 206S, and 206T in the longitudinal direction thereof.

Figure 9:
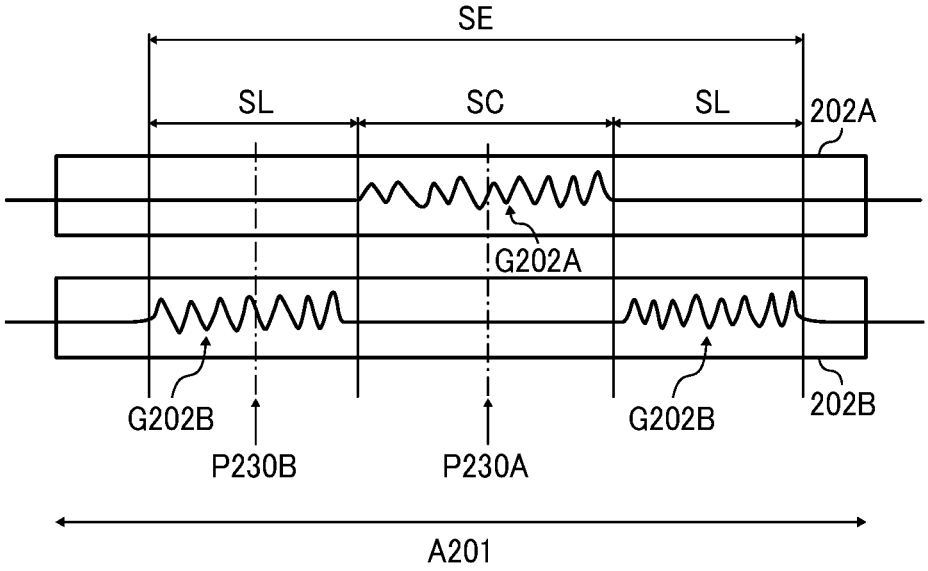
FIG. 9 is a diagram of a center heater and a lateral end heater incorporated in the fixing device depicted in FIG. 2.
Figure 10:
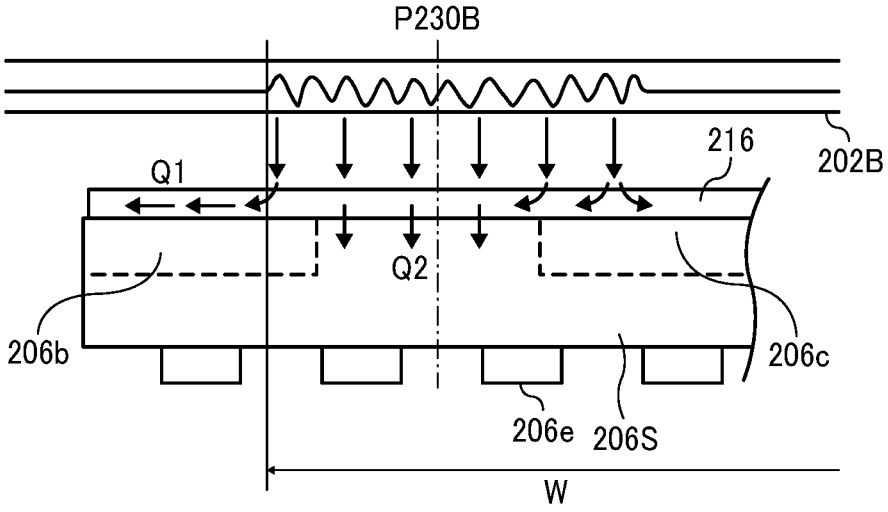
FIG. 10 is a diagram of the lateral end heater and a nip formation pad of the nip formation assembly depicted in FIG. 7.
Figure 11:
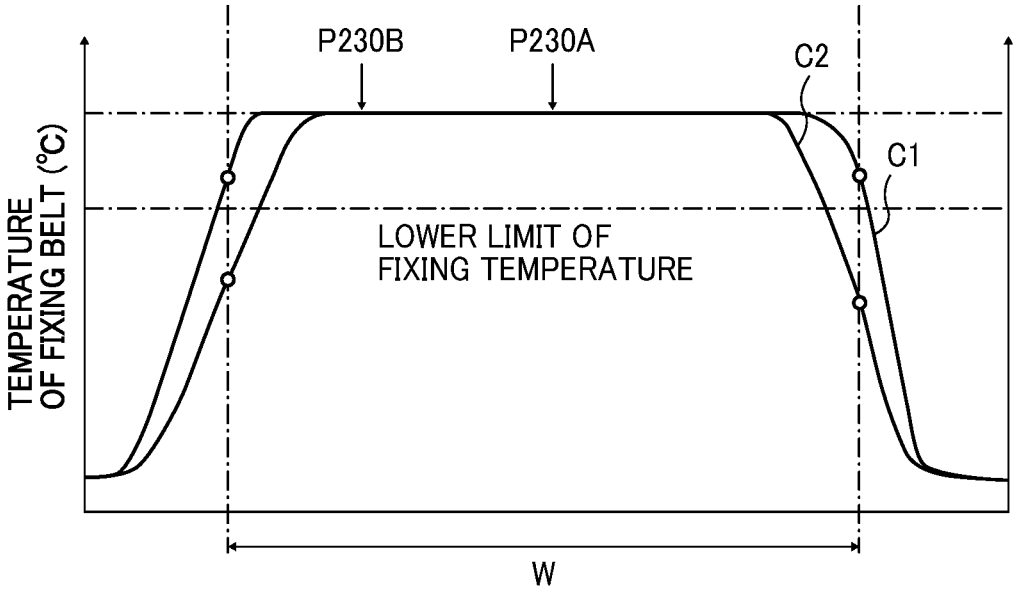
FIG. 11 is a graph illustrating a temperature distribution of a fixing belt incorporated in the fixing device depicted in FIG. 2.

Referring to FIGS. 9, 10, and 11, a description is provided of advantages of the nip formation assemblies 6, 6S, and 6T depicted in FIGS. 6, 7, and 8, respectively, as one example.

FIG. 9 is a diagram of the center heater 202A and the lateral end heater 202B, illustrating a positional relation between a heat generation span of each of the center heater 202A and the lateral end heater 202B and each of the center temperature sensor 230A and the lateral end temperature sensor 230B. FIG. 9 illustrates a relation between a position of the center heater 202A as one example of a center heater and the position P230A of the center temperature sensor 230A as one example of a center temperature detector and a relation between a position of the lateral end heater 202B as one example of a lateral end heater and the position P230B of the lateral end temperature sensor 230B as one example of a lateral end temperature detector. The fixing belt 201 extends horizontally in FIG. 9 in the longitudinal direction, that is, an axial direction A201, of the fixing belt 201. Each of the center heater 202A and the lateral end heater 202B extends in the axial direction A201 of the fixing belt 201.

As illustrated in FIG. 9, the center heater 202A includes a center heat generator G202A indicated with a wave. The lateral end heater 202B includes lateral end heat generators G202B indicated with waves. The waves of the center heat generator G202A and the lateral end heat generators G202B indicate densely coiled portions of filaments which generate heat as the filaments are supplied with power and are coiled more densely than other portions of the filaments of the center heater 202A and the lateral end heater 202B. The densely coiled portions of the filaments generate a greater amount of heat compared to other portions of the filaments, thus defining heat generation spans SC and SL. In each of the center heater 202A and the lateral end heater 202B as a halogen heater, the filament is coiled partially densely and partially loosely and disposed inside a tubular transparent glass tube filled with halogen gas. Thus, the center heater 202A and the lateral end heater 202B serve as a heater that heats the fixing belt 201. FIG. 9 does not illustrate the fixing belt 201 to clarify the relation between the position of the center heater 202A and the position P230A of the center temperature sensor 230A and the relation between the position of the lateral end heater 202B and the position P230B of the lateral end temperature sensor 230B.

A description is provided of a configuration of the center heater 202A as one example of a center heater and the lateral end heater 202B as one example of a lateral end heater.

The center heater 202A generates heat in the heat generation span SC corresponding to a width of 210 mm of an A4 size sheet in portrait orientation. The lateral end heater 202B generates heat in the heat generation spans SL that, together with the heat generation span SC, define a heat generation span SE corresponding to a width of 320 mm of an A3 extension size sheet in portrait orientation. The heat generation spans SL as lateral end spans are combined with the heat generation span SC as a center span to define the heat generation span SE as a combined span. When the center heater 202A and the lateral end heater 202B generate heat, the fixing device 200 produces the heat generation span SE equivalent to the width of the A3 extension size sheet in portrait orientation as the maximum conveyance span. The center heater 202A has the heat generation span SC in a center span of the center heater 202A in a longitudinal direction thereof and is installed in the fixing device 200 such that the center heater 202A heats a center span of the fixing belt 201 in the axial direction A201. Conversely, the lateral end heater 202B has the heat generation spans SL at both lateral ends of the lateral end heater 202B in a longitudinal direction thereof and is installed in the fixing device 200 such that the heat generation spans SL are substantially symmetrical with each other via the center of the fixing belt 201 in the axial direction A201 thereof.

A description is provided of a configuration of the center temperature sensor 230A as one example of a center temperature detector and the lateral end temperature sensor 230B as one example of a lateral end temperature detector.

The center temperature sensor 230A is disposed opposite the fixing belt 201 at the position P230A, that is, at substantially a center of the heat generation span SC corresponding to the width of the A4 size sheet in portrait orientation in the axial direction A201 of the fixing belt 201 to detect the temperature of the outer circumferential surface of the fixing belt 201. The lateral end temperature sensor 230B is disposed opposite the fixing belt 201 at the position P230B, that is, at substantially a center of the heat generation span SL between a lateral edge of the heat generation span SC and a lateral edge of the heat generation span SL in the axial direction A201 of the fixing belt 201 to detect the temperature of the outer circumferential surface of the fixing belt 201.

FIG. 10 is a diagram of the lateral end heater 202B and the nip formation pad 206S of the nip formation assembly 6S depicted in FIG. 7 as one example, illustrating heat conduction from the lateral end heater 202B to the thermal conduction aid 216 through the fixing belt 201 and further heat conduction from the thermal conduction aid 216 to the nip formation pad 206S. FIG. 10 does not illustrate the fixing belt 201 to clarify heat conduction. A length of the nip formation pad 206S is substantially equal to a length of the thermal conduction aid 216 in the longitudinal direction thereof. Alternatively, one of the nip formation pad 206S and the thermal conduction aid 216 may be greater than another one of the nip formation pad 206S and the thermal conduction aid 216 in the longitudinal direction thereof.

Heat emitted from the lateral end heater 202B is conducted to the thermal conduction aid 216 through the fixing belt 201. As described above, the thermal conduction aid 216 is greater than the maximum conveyance span in the longitudinal direction of the thermal conduction aid 216. The maximum conveyance span substantially corresponds to the heat generation span SE depicted in FIG. 9 produced by the center heater 202A and the lateral end heater 202B that are powered on. As illustrated in FIG. 10, energy Q1 moved to an outboard span disposed (e.g., an outboard span S2 depicted in FIG. 7) outboard from a maximum conveyance span W in the longitudinal direction of the thermal conduction aid 216 where the maximum size sheet (e.g., the A3 extension size sheet) available in the fixing device 200 is conveyed is diffused without being used to heat and fix the toner image on the recording sheet S. Accordingly, the lateral end of the fixing belt 201 suffers from temperature decrease at a lateral end of the maximum conveyance span W by the energy Q1 diffused to an outermost end of the thermal conduction aid 216 in the longitudinal direction thereof.

The fixing belt 201 retains a fixing temperature sufficient to fix the toner image on the recording sheet S in the lateral end detection span S230B where the controller 18 depicted in FIG. 3 performs the feedback control based on the temperature of the fixing belt 201 detected by the lateral end temperature sensor 230B to retain a target temperature. Conversely, the lateral end temperature sensor 230B does not detect the temperature of the fixing belt 201 in an outboard span outboard from the lateral end detection span S230B in the axial direction A201 of the fixing belt 201 even if the fixing belt 201 suffers from temperature decrease. Accordingly, the controller 18 does not perform the feedback control to retain the target temperature. Consequently, even if the fixing belt 201 is heated to the fixing temperature sufficient to fix the toner image on the recording sheet S in the lateral end detection span S230B, the fixing belt 201 may suffer from temperature decrease at the lateral end of the maximum conveyance span W by the energy Q1 diffused through the thermal conduction aid 216 from a lateral edge of the lateral end detection span S230B to a lateral edge of the thermal conduction aid 216 in the longitudinal direction thereof without being used to heat and fix the toner image on the recording sheet S. Thus, the fixing device 200 may suffer from fixing failure.

In the nip formation assemblies 6, 6S, and 6T depicted in FIGS. 6, 7, and 8, respectively, each of the nip formation pads 206, 206S, and 206T does not mount the grooves 206*b* and 206*c* in the lateral end detection span S230B and a periphery thereof. Accordingly, energy Q2 moves from a contact portion of the thermal conduction aid 216 that contacts the nip formation pad 206S and diffuses through the nip formation pad 206S without being used to heat and fix the toner image on the recording sheet S. Consequently, the fixing belt 201 suffers from temperature decrease in the lateral end detection span S230B and the periphery thereof by the energy Q2 drawn to the nip formation pad 206S compared to a case in which heat is not drawn to the nip formation pad 206S. The controller 18 adjusts the rate to power on the lateral end heater 202B based on the temperature of the fixing belt 201 detected in the lateral end detection span S230B. Accordingly, the lateral end heater 202B is powered on for an extended period of time to retain the target temperature compared to a case in which the energy Q2 does not generate. Consequently, the fixing belt 201 receives an increased amount of heat from the lateral end heater 202B also in the outboard span S2 disposed outboard from the lateral end detection span S230B in the axial direction A201 of the fixing belt 201.

Hence, by adjusting the energy Q1 and the energy Q2 depicted in FIG. 10, an amount of energy drawn from the fixing belt 201 is equalized substantially in the axial direction A201 of the fixing belt 201, enhancing evenness of the temperature of the fixing belt 201 and preventing temperature decrease of the lateral end of the fixing belt 201 in the axial direction A201 thereof. For example, the controller 18 adjusts the temperature of the fixing belt 201 in the axial direction A201 thereof by adjusting an amount of the energy Q1 diffused through the thermal conduction aid 216 and an amount of the energy Q2 diffused to the nip formation pad 206S in the lateral end detection span S230B.

FIG. 11 is a graph illustrating a temperature distribution of the fixing belt 201 in the axial direction A201 thereof. In FIG. 11, a curve C1 represents the temperature of the fixing belt 201 of the fixing devices 200 and 200S according to the embodiments described above, which varies in the axial direction A201 thereof. A curve C2 represents the temperature of a fixing belt of a comparative fixing device that does not incorporate the nip formation assemblies 6, 6S, and 6T, which varies in an axial direction of the fixing belt. As illustrated in FIG. 11, when the temperature of the fixing belt 201 reaches a desired temperature under the control performed by the controller 18 based on the temperature of the fixing belt 201 detected by the lateral end temperature sensor 230B, the temperature of the fixing belt 201 at the lateral end of the maximum conveyance span W increases compared to a general control. Consequently, according to this embodiment, the fixing belt 201 attains a fixing strength at the lateral end of the maximum conveyance span W.

As illustrated in FIG. 9, the lateral end heater 202B has the heat generation span SL in another lateral end of the lateral end heater 202B in the longitudinal direction thereof, in addition to the heat generation span SL in one lateral end of the lateral end heater 202B depicted in FIG. 10. As the lateral end heat generators G202B of the lateral end heater 202B and the center heat generator G202A of the center heater 202A depicted in FIG. 9 generate heat, while the recording sheet S is conveyed through the fixing nip N such that a substantial center of the fixing belt 201 in the axial direction A201 thereof overlaps a substantial center of the recording sheet S, the fixing belt 201 fixes the toner image on the recording sheet S.

The groove 206*a* is disposed in a lateral end span of the nip formation pad 206S where the lateral end temperature sensor 230B is not disposed opposite the fixing belt 201 such that the groove 206*a* is substantially symmetrical with the groove 206*b* via the substantial center of the fixing belt 201 in the axial direction A201 thereof. For example, like one lateral end span, that is, the first span S1 encompassing the lateral end detection span S230B that encompasses the position P230B of the lateral end temperature sensor 230B, another lateral end span, that is, the symmetrical span S3, which is substantially symmetrical with the first span S1 via the substantial center of the fixing belt 201 in the axial direction A201 thereof, also has the groove 206*a*.

In the symmetrical span S3, the nip formation pad 206S contacts the thermal conduction aid 216 in a contact area which is greater than a contact area of an outboard span S4 outboard from the symmetrical span S3 in the longitudinal direction of the nip formation pad 206S. In the outboard span S4, the nip formation pad 206S contacts the thermal conduction aid 216. Accordingly, the controller 18 performs adjustment of the energy Q1 and the energy Q2 substantially similarly in both lateral end spans of the nip formation pad 206S in the longitudinal direction thereof. Consequently, the fixing belt 201 attains the fixing strength at both lateral ends of the maximum conveyance span W in the axial direction A201 of the fixing belt 201. The shape, the depth, and the like of the grooves 206*a*, 206*b*, and 206*c* may vary between both lateral end spans of the nip formation pad 206S in the longitudinal direction thereof as long as the controller 18 adjusts the energy Q1 and the energy Q2 to attain the fixing strength.

As described above, if the thermal conduction aid 216 is configured to contact the fixing belt 201, heat stored in the fixing belt 201 may be conducted and diffused to the thermal conduction aid 216 that is in contact with the fixing belt 201 and made of a material having a greater thermal conductivity. Heat is further conducted and diffused to the nip formation pad 206S contacting the thermal conduction aid 216. As heat is diffused from the lateral end of the fixing belt 201 in the axial direction A201 thereof to the outermost end of the thermal conduction aid 216 in the longitudinal direction thereof, heat may be drawn more from the lateral end of the fixing belt 201 and therefore the fixing belt 201 may suffer from temperature decrease.

A length of the thermal conduction aid 216 in the longitudinal direction thereof is greater than the maximum conveyance span W where the maximum size sheet available in the fixing device 200 is conveyed in view of manufacturing error. For example, immediately after the fixing device 200 is warmed up when the entire fixing device 200 is cool and is subject to heat dissipation, energy generated by the center heater 202A and the lateral end heater 202B is subject to diffusion to each lateral end of the thermal conduction aid 216 in the longitudinal direction thereof. Accordingly, each lateral end of the fixing belt 201 in the axial direction A201 thereof may suffer from heat conduction to the thermal conduction aid 216 contacting the fixing belt 201 and resultant temperature decrease. Consequently, each lateral end of the fixing belt 201 in the axial direction A201 thereof may suffer from degradation in fixing performance, causing faulty image formation such as offset.

To address this circumstance, according to the embodiments described above, the thermal conduction aid 216 contacts each of the nip formation pads 206, 206S, and 206T with a decreased contact area in an outermost span of the fixing belt 201 in the axial direction A201 thereof, thus preventing heat stored in the fixing belt 201 from being drawn to each of the nip formation pads 206, 206S, and 206T through the thermal conduction aid 216. The thermal conduction aid 216 contacts each of the nip formation pads 206, 206S, and 206T with an increased contact area in an inboard span of the fixing belt 201 that is inboard from the outermost span in the axial direction A201 thereof, thus facilitating conduction of heat stored in the fixing belt 201 from the fixing belt 201 to each of the nip formation pads 206, 206S, and 206T through the thermal conduction aid 216.

Accordingly, an amount of energy diffused to the outermost span of the thermal conduction aid 216 in the longitudinal direction thereof is equalized to an amount of energy diffused to each of the nip formation pads 206, 206S, and 206T in the inboard span having the increased contact area. Consequently, the amount of energy stored in the fixing belt 201 is equalized in the axial direction A201 of the fixing belt 201. As a result, the temperature of the fixing belt 201 is even to each lateral end of the fixing belt 201 in the axial direction A201 thereof immediately after the fixing device 200 is warmed up, thus preventing temperature decease of each lateral end of the fixing belt 201 in the axial direction A201 thereof.

A description is provided of advantages of the fixing devices 200 and 200S.

As illustrated in FIGS. 2 and 4, a fixing device (e.g., the fixing devices 200 and 200S) includes a fixing rotator (e.g., the fixing belt 201), a heater (e.g., the heater pair 202), a nip formation assembly (e.g., the nip formation assemblies 6, 6S, and 6T), a pressure rotator (e.g., the pressure roller 203), and a temperature detector (e.g., the temperature sensor pair 230).

The fixing rotator is endless and rotatable in a rotation direction (e.g., the rotation direction D201). The heater heats the fixing rotator. The nip formation assembly is disposed opposite an inner circumferential surface of the fixing rotator. The pressure rotator is pressed against the nip formation assembly via the fixing belt to form a fixing nip (e.g., the fixing nip N) between the fixing rotator and the pressure rotator. As a recording medium bearing a toner image is conveyed through the fixing nip, the fixing rotator and the pressure rotator fix the toner image on the recording medium.

The nip formation assembly includes a thermal conduction aid (e.g., the thermal conduction aid 216) and a nip formation pad (e.g., the nip formation pads 206, 206S, and 206T). The thermal conduction aid contacts the inner circumferential surface of the fixing rotator. The nip formation pad is disposed opposite the fixing rotator via the thermal conduction aid and contacts the thermal conduction aid.

The heater includes a lateral end heater (e.g., the lateral end heater 202B) that heats a lateral end span of the fixing rotator in an axial direction (e.g., the axial direction A201) thereof.

The temperature detector includes a lateral end temperature detector (e.g., the lateral end temperature sensor 230B) that detects a temperature of the fixing rotator heated by the lateral end heater in a lateral end detection span (e.g., the lateral end detection span S230B) in the lateral end span of the fixing rotator. The lateral end detection span encompasses a detection position (e.g., the position P230B) where the lateral end temperature detector is disposed opposite the fixing rotator. The thermal conduction aid contacts the nip formation pad in a first span (e.g., the first span S1) encompassing the lateral end detection span in the axial direction of the fixing rotator with a first contact area. The thermal conduction aid contacts the nip formation pad in a second span (e.g., the outboard span S2) disposed outboard from the first span in the axial direction of the fixing rotator with a second contact area smaller than the first contact area.

Accordingly, the fixing device improves fixing performance even at a lateral end of the recording medium in the axial direction of the fixing rotator.

According to the embodiments described above, the fixing belt 201 serves as a fixing rotator. Alternatively, a fixing film or the like may be used as a fixing rotator. Further, the pressure roller 203 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing rotator that is endless and rotatable in a rotation direction;

a lateral end heater to heat a lateral end span of the fixing rotator in an axial direction of the fixing rotator;

a thermal conduction aid contacting an inner circumferential surface of the fixing rotator;

a nip formation pad contacting the thermal conduction aid;

a pressure rotator to press against the nip formation pad via the fixing rotator and the thermal conduction aid to form a fixing nip between the fixing rotator and the pressure rotator, the fixing nip through which a recording medium bearing a toner image is conveyed; and a lateral end temperature detector to detect a temperature of the fixing rotator in a lateral end detection span in the axial direction of the fixing rotator, wherein the thermal conduction aid contacts the nip formation pad in a first span including the lateral end detection span in the axial direction of the fixing rotator with a first contact area, wherein the thermal conduction aid contacts the nip formation pad in a second span disposed outboard from the first span in the axial direction of the fixing rotator with a second contact area smaller than the first contact area, and wherein the nip formation pad includes a groove disposed opposite the thermal conduction aid in at least a part of the second span.

2. The fixing device according to claim 1, wherein the groove originates at a lateral edge of the nip formation pad and extends to a position disposed outboard from the lateral end temperature detector by 10 mm in the axial direction of the fixing rotator.

3. The fixing device according to claim 1, wherein the nip formation pad further includes a beam disposed at a center of the groove in a direction perpendicular to the axial direction of the fixing rotator and extended in the axial direction of the fixing rotator.

4. The fixing device according to claim 1, wherein the thermal conduction aid contacts the nip formation pad in a third span being symmetrical with the first span via a center of the fixing rotator in the axial direction of the fixing rotator with a third contact area, and wherein the thermal conduction aid contacts the nip formation pad in a fourth span disposed outboard from the third span in the axial direction of the fixing rotator with a fourth contact area smaller than the third contact area.

5. The fixing device according to claim 4, wherein the nip formation pad includes another groove disposed opposite the thermal conduction aid in at least a part of the fourth span.

6. The fixing device according to claim 4, further comprising a center heater to heat a center span of the fixing rotator in the axial direction of the fixing rotator.

7. The fixing device according to claim 6, wherein the nip formation pad includes another groove disposed opposite the thermal conduction aid in at least a part of the center span.

8. The fixing device according to claim 6, wherein the lateral end span is combined with the center span to define a combined span in the axial direction of the fixing rotator, the combined span corresponding to a maximum conveyance span where the recording medium having a maximum width of a plurality of widths of recording media is conveyed through the fixing device.

9. The fixing device according to claim 1, wherein the nip formation pad is made of resin.

10. The fixing device according to claim 1, wherein the thermal conduction aid includes a metal plate.

11. The fixing device according to claim 1, wherein the lateral end heater includes a halogen heater.

12. The fixing device according to claim 1, wherein the lateral end temperature detector includes a temperature sensor.

13. The fixing device according to claim 1, wherein the fixing rotator includes a fixing belt and the pressure rotator includes a pressure roller.

14. A fixing device comprising:

a fixing rotator that is endless and rotatable in a rotation direction;

a thermal conduction aid contacting an inner circumferential surface of the fixing rotator;

a nip formation pad contacting the thermal conduction aid;

a pressure rotator to press against the nip formation pad via the fixing rotator and the thermal conduction aid to form a fixing nip between the fixing rotator and the pressure rotator, the fixing nip through which a recording medium bearing a toner image is conveyed;

a temperature detector to detect a temperature of the fixing rotator in a detection span within a recording medium conveyance span in an axial direction of the fixing rotator, the recording medium conveyance span where the recording medium is conveyed;

a heater to heat the fixing rotator; and a controller to control the heater to heat the fixing rotator to a target temperature based on the temperature of the fixing rotator detected by the temperature detector, wherein the thermal conduction aid conducts a first amount of heat to the nip formation pad in the detection span in the axial direction of the fixing rotator, wherein the thermal conduction aid conducts a second amount of heat to the nip formation pad in an outboard span disposed outboard from the recording medium conveyance span in the axial direction of the fixing rotator, the second amount of heat being smaller than the first amount of heat, and wherein the nip formation pad includes a groove disposed opposite the thermal conduction aid in at least a part of the outboard span.

15. An image forming apparatus comprising:

an image bearer to bear a toner image; and a fixing device to fix the toner image on a recording medium, the fixing device including:

a fixing rotator that is endless and rotatable in a rotation direction;

a lateral end heater to heat a lateral end span of the fixing rotator in an axial direction of the fixing rotator;

a thermal conduction aid contacting an inner circumferential surface of the fixing rotator;

a nip formation pad contacting the thermal conduction aid;

a pressure rotator to press against the nip formation pad via the fixing rotator and the thermal conduction aid to form a fixing nip between the fixing rotator and the pressure rotator, the fixing nip through which the recording medium bearing the toner image is conveyed; and a lateral end temperature detector to detect a temperature of the fixing rotator in a lateral end detection span in the axial direction of the fixing rotator, wherein the thermal conduction aid contacts the nip formation pad in a first span including the lateral end detection span in the axial direction of the fixing rotator with a first contact area, wherein the thermal conduction aid contacts the nip formation pad in a second span disposed outboard from the first span in the axial direction of the fixing rotator with a second contact area smaller than the first contact area, and wherein the nip formation pad includes a groove disposed opposite the thermal conduction aid in at least a part of the second span.

* * * * *